US007776253B2

(12) United States Patent
Morozov et al.

(10) Patent No.: US 7,776,253 B2
(45) Date of Patent: Aug. 17, 2010

(54) INSTALLATION FOR SUPPLYING MATERIALS INTO METALLURGICAL UNIT

(75) Inventors: Andrei Andreevich Morozov, Magnitogorsk (RU); Rafkat Spartakovich Takhautdinov, Magnitogorsk (RU); Anatoly Yakovlevich Nakonechny, Donetsk (UA); Vladimir Nikolaevich Urtsev, Magnitogorsk (RU); Dim Maratovich Khabibulin, Magnitogorsk (RU); Felix Vilenovich Kaptsan, Magnitogorsk (RU); Sergei Nikolaevich Anikeev, Moscow (RU); Sergei Iosifovich Platov, Magnitogorsk (RU); Vadim Yurievich Shtol, Magnitogorsk (RU)

(73) Assignee: Obschestvo S Ogranichennoi Otvetstvennostyu "Issledovatelsko-Tekhnologichesky Tsentr Ausferr", Magnitogorsk (RU)

( * ) Notice: Subject to any disclaimer, the term of this patent is extended or adjusted under 35 U.S.C. 154(b) by 523 days.

(21) Appl. No.: 11/815,735

(22) PCT Filed: Feb. 3, 2006

(86) PCT No.: PCT/RU2006/000044

§ 371 (c)(1),
(2), (4) Date: Aug. 7, 2007

(87) PCT Pub. No.: WO2006/085795

PCT Pub. Date: Aug. 17, 2006

(65) Prior Publication Data

US 2008/0211146 A1 Sep. 4, 2008

(30) Foreign Application Priority Data

Feb. 7, 2005 (RU) ..... 2005102752

(51) Int. Cl.
*C21C 7/00* (2006.01)

(52) U.S. Cl. ..... 266/184; 266/199; 373/81

(58) Field of Classification Search ..... 266/199, 266/184; 373/81
See application file for complete search history.

(56) References Cited

U.S. PATENT DOCUMENTS 3,651,964 A * 3/1972 Nieboer ..... 266/184

(Continued)

FOREIGN PATENT DOCUMENTS

EP 0088253 A1 9/1983

(Continued)

OTHER PUBLICATIONS

Arist, L.M., Shcherbin, A.I., "Mekhanizatsia Rabot v Domennom i Staleplavil'nom Proizvodstvakh" (Mechanization of Works in Blast-Furnace and Steelmaking Plants)—K: Tekhinka (The Engineering Publishers), 1991, pp. 48-49).

*Primary Examiner*—Scott Kastler
(74) *Attorney, Agent, or Firm*—Volpe and Koenig, P.C.

(57) ABSTRACT

An installation is provided for supplying materials into a metallurgical unit by the alloying steel for synchronizing the process of melting the supplied materials and reducing the alloying elements. The installation includes a distributor gear made as a funnel and a swivel launder with a drive, and intermediate hoppers interconnected with a pipe-chute. The installation is provided with a housing having a lid and means for fastening to structures of a plant. The funnel is mounted in the lid, the swivel launder is mounted under the lid and the intermediate hoppers are positioned radially in the housing to form a cavity by hopper surfaces facing a longitudinal axis of the installation, said cavity being separated from the interior of the hoppers, which are coupled to the pipe chute by discharge openings formed therein and shutters mounted to move relative to a longitudinal axis of a hopper.

12 Claims, 4 Drawing Sheets

U.S. PATENT DOCUMENTS 3,706,387 A * 12/1972 Tokarz ..... 266/184
4,348,225 A * 9/1982 Maeda et al. ..... 266/184

FOREIGN PATENT DOCUMENTS

RU 2010865 C1 4/1994
RU 2010866 C1 4/1994
SU 476449 A 7/1975
SU 963474 A 9/1982
SU 1020442 A 5/1983

* cited by examiner

INSTALLATION FOR SUPPLYING MATERIALS INTO METALLURGICAL UNIT

FIELD OF INVENTION

The invention relates to ferrous metallurgy, particularly to installations for supplying materials into steelmaking units, steel-teeming ladles, installations for the out-of-furnace treatment, and intermediate tanks of machines for continuous casting of billets, and can be used in steelmaking using a direct alloying process.

BACKGROUND

Processes are currently developed in the world practice of steelmaking that use the direct alloying process wherein nonmetal compounds containing an alloying element are used as alloying, modifying additives supplied into metallurgical units with a reducing agent in series or jointly, or in the form of mixtures or briquettes. One of important moments in the direct alloying technology is synchronization of the processes of melting materials to be supplied, reducing alloying elements, and deoxidizing steel. For this purpose, raw materials are supplied in such an order and in such ratios that their melting takes place simultaneously, practically at the same rate. Such supplying provides forming of a homogeneous phase consisting of materials that participate in the reduction process. Accordingly, the reaction of reducing the alloying elements begins and goes simultaneously with the melting process and provides thereby a high rate and completeness of the reduction process.

Taking into account that the requirements to the quality of steel currently increase practically throughout its entire range, the necessity occurs to perform additional procedures, particularly, steel micro-alloying and steel modifying. Combining of the processes of steel alloying and steel modifying seems impossible by using of the existing equipment for supplying necessary materials. According to the existing technologies, the alloying and modifying processes are carried out separately: the alloying takes place in a steel-teeming ladle during discharge of a metal while the micro-alloying and modifying take place in the out-of-furnace treatment installations. This implies the necessity to use additional equipment in the form of injection installations, tribe-apparatuses and others, overheat of metal prior to discharge or in ladle furnace installations; apart from increase in energetic and material costs, this results in prolongation of the melting cycle.

To realize both the steelmaking processes using the direct alloying and the possibility to combine the alloying and modifying processes, is it necessary to use systems for supplying materials into a metallurgical unit that permits the supply of necessary materials at a controllable rate, mass, sequence. The steelmaking processes using the direct alloying and the possibility to combine the alloying and modifying processes have required to solve the question of creating such an apparatus that could provide the supply of a strictly regulated amount of necessary materials according to predetermined programs and sequence of supplying thereof.

Known is an installation for supplying materials into a metallurgical unit (a steelmelting unit and a ladle), comprising storage hoppers for slag-forming materials, carbonaceous materials, and oxidized materials, hoppers for storing deoxidizing agents and alloying agents, a system for supplying material into the steelmaking unit, said system including screens and electro-vibrating feeders, weighting batchers, intermediate hoppers with gates and mounted above the steelmaking unit, all being positioned in a technological sequence, and systems for supplying materials into the steel-teeming ladle, said systems including electro-vibrating feeders, weighting batchers and charge funnels with pipe-chutes, all being positioned in a technological sequence (Arist, L. M., Shcherbin, A. I., "Mekhanizatsia Rabot v Domennom i Staleplavil'nom Proizvodstvakh" (Mechanization of Works in Blast-Furnace and Steelmaking Plants)—K.: Tekhinka (The Engineering Publishers), 1991, pp. 48-49).

It seems impossible to implement the steel alloying and modifying processes using the direct steel alloying process in such an installation, because the structural embodiment of the installation does not provide the timely supply of all materials necessary for direct alloying, that is, nonmetallic materials containing alloying elements, reducing agents and slag-forming materials, into the steelmaking unit or into the steel-teeming ladle.

Known is a continuous production line for preparing and supplying slag-forming mixtures into a steelmaking unit and ladle, comprising receiving hoppers with gates, weighting batchers, collecting hoppers coupled to each other by conveyors with discharge mechanisms and chutes, all being mounted according to the course of the manufacturing process, wherein the receiving hoppers are made with inclined chutes fastened under the gates and the continuous production line is provided with continuous weighting devices, material-overflow chutes, a combined tank connected to an aspiration system, said continuous weighting devices being fastened under the included chutes of the receiving hoppers and made by-pair-integrated into the combined tank while the material-overflow chutes being mounted so as to change a direction of supplying material from a charge path of the steelmaking unit into a system for inlet into the ladle (RU 2,010,865 C1, IPC C21C 7/00, 1994).

Employment of the prior art installation covers only the supply of two materials into the steelmaking unit or into the steel-teeming ladle. Said materials are slag-forming materials—lime and fluor-spar.

The known installation solves a practical problem of preparing the mixture of slag-forming materials comprising only two materials—lime and fluor-spar.

At least three materials should be used as raw materials in the technology of steel alloying with any alloying elements: a material containing an alloying element, a reducing agent, and a slag-forming additive.

In accordance with the solution of RU 2,010,865, the prepared mixture of the slag-forming materials—lime and fluor-spar in the predetermined fixed ratio equal to 4:1—is supplied into one combined tank from which the finished mixture is directed through respective chutes into the steelmaking unit or into the steel-teeming ladle.

Use of the prior art installation does not provide the required mode of regulated supplying materials necessary for direct steel alloying because the regulated and timely supply of all materials is not provided as well as the required operation speed in supply of materials into the steelmaking unit or into the steel-teeming ladle.

Because of necessity to supply materials in the direct alloying technology according to a predetermined, always strictly preset sequence and not in the form a mixture of all supplied materials, wherein said necessity being connected with different times of melting the supplied materials, it is inexpedient to use the prior art installation since this results in violation of the preset technological regulations and impossibility to implement the process of direct steel alloying.

Known is an installation for supplying material into a steelmaking furnace and into a steel-teeming ladle, mounted in the prior art continuous production line for supplying materials by electric-furnace steelmaking, comprising a distributing device made as a multi-section funnel with a swivel launder and a drive thereof, wherein sections of the funnel are connected by direct-flow chutes for supplying materials into the steelmaking furnace and into the steel-teeming ladle and by functionally-independent chutes for supplying materials during treatment of steel in ladles under which intermediate hoppers are mounted with feeders at bases of which hopper scales for small dozes are positioned under which the funnel is fastened, and a flow divider (SU 1,020,442, IPC C21C 7/00, published on May 30, 1983).

It seems impossible to accomplish the operation speed in supply of necessary materials for direct steel alloying with the controllable supply sequence and rate using the prior art installation, because all necessary materials are supplied according to the prior art invention from one tank—the hopper scale for small dozes at which the necessary materials arrive through the feeders from the intermediate hoppers. Therefore, by supplying, for example, of three materials, it is necessary to supply all necessary materials in series to the hopper scale and supply them already as a mixture into the steelmaking unit or into ladle, which is unacceptable for the technology of direct steel alloying where materials are supplied advantageously separately, or in turn. This leads to breakdown in the manufacturing process of direct alloying that provides the supply of necessary materials in a strict sequence and at compliance with the necessary regulations.

With such a structural embodiment of supplying the necessary materials from the intermediate hoppers into the steelmaking unit or ladle, it seems impossible to implement synchronism of processes taking place by direct steel alloying, first of all, because of violating the mode of independent supplying necessary materials as well as violating the technological regulations of direct steel alloying in process of operation of the installation.

SUMMARY

An object being the basis of the present invention is creating an installation providing the fast supply of materials into a metallurgical unit for synchronizing the processes of melting raw materials and reducing alloying elements from nonmetallic compounds in implementation of direct steel alloying.

An expected effect is provision of the operation speed during the supply of materials in a strictly preset mode and in compliance with required regulations in process of direct steel alloying.

The technical result is accomplished by that an installation for supplying materials into a metallurgical unit, comprising a distributing device made as a funnel and a swivel launder with a drive, and intermediate hoppers interconnected with a pipe-chute, in accordance with the invention is provided with a housing having a lid and means for fastening to structures of a plant, wherein the funnel is mounted in the lid, the swivel launder is mounted under the lid, and the intermediate hoppers are positioned radially in the housing to form a cavity by hopper surfaces facing a longitudinal axis of the installation, said cavity being separated from the interior of the hoppers, wherein the hoppers are coupled to the pipe-chute by means of discharge openings formed therein and shutters mounted to move relative to a longitudinal axis of a hopper.

It is advantageous to have a hopper cross-section being a segment. It is necessary for optimal placement of the hoppers radially within the housing and to provide thereby the possibility of simultaneous supplying several materials from several hoppers as well as to prevent hang-up of large-fraction materials (having a size of more than 70 mm) in a hopper.

It is advantageous to make the intermediate hoppers removable. Presence of the removable hoppers in said installation makes it possible to replace the hoppers without interruption of the manufacturing process and also to perform assemblage thereof in the installation after pre-charging with special materials used in the direct alloying technology, for example, to modify steel, exactly, fine-fraction materials containing oxides or other compounds of rare-earth, alkaline-earth or other elements.

It is advantageous to have the housing provided with partitions mounted radially therein and moveable along the longitudinal axis of the installation. When charging the intermediate hoppers with materials necessary to implement the direct alloying process, frequently used materials are taken into account that are necessary practically for all grades of steel, for example, such as manganese-containing materials and also materials that are used in orders for melting special grades of steel and have rare-earth elements, vanadium, boron, etc., in their compositions. Therefore, it is advantageous to have the hoppers of different capacities in the installation: large hoppers for frequently used materials and smaller hoppers for production of special-purpose steels. In this case, arrangement of the installation is performed by setting respective hoppers of required capacities using radially mounted partitions that can move along the longitudinal axis of the installation.

It is advantageous to make the housing frame-shaped. The frame-shaped structure of the housing allows operative movement of the installation within the plant from one unit to another as well as operatively maintenance of the installation and repair works with decrease of the specific amount of metal in the installation.

It is advantageous to form discharge openings in a surface of hoppers facing the longitudinal axis of the installation, wherein the shutters should be mounted to move along a longitudinal axis of a hopper by means of pneumatic cylinders placed in a cavity formed by hopper surfaces facing the longitudinal axis of the installation.

It is advantageous to form the discharge openings in a bottom of hoppers, wherein the shutters should be mounted to move perpendicularly to a longitudinal axis of a hopper by means of pneumatic cylinders placed under the bottom of hoppers.

It is advantageous to form a hopper bottom as a pyramid whose vertex faces the pipe-chute. In this case it is desirable to have a hopper cross-section in shape of a segment and to form the discharge openings in a pyramid face facing the housing while the shutters should be mounted to move at an angle to a longitudinal axis of a hopper by means of pneumatic cylinders positioned outside of the housing.

It is advantageous to mount the hoppers on strain-gauge scales and couple to the housing by means of guide rollers mounted in areas of the housing periphery whose axes are parallel to the longitudinal axis of the installation.

The necessary condition to realize the process of direct steel alloying is arrival of operative information about an accurate amount—in whole or in portions—of supplied materials from each intermediate hopper; to this end, it is reasonable to mount the hoppers on strain-gauge scales thereby to provide synchronism of melting several supplied materials and reducing alloying elements therefrom.

It is advantageous to provide the installation with a vibrator interconnected with the hoppers.

It is advantageous to mount a partition within the funnel to rotate in a vertical plane relative to the longitudinal axis of the installation.

The installation is designed for fast supplying metals in a preset mode at compliance with required regulations and for providing thereby a realization of the technology for direct steel alloying in different steelmaking units (oxygen-blown converters, electric arc furnaces), steel-teeming ladles, ladle-furnace installations, and others. Use of the inventive installation to realize the technology for direct steel alloying allows: significant decrease of the melting cycle due to shortening a time for out-of-furnace treatment that includes alloying steel; increase in productivity; improvement in the quality of steel.

DETAILED DESCRIPTION OF THE PREFERRED EMBODIMENTS

Figure 1:
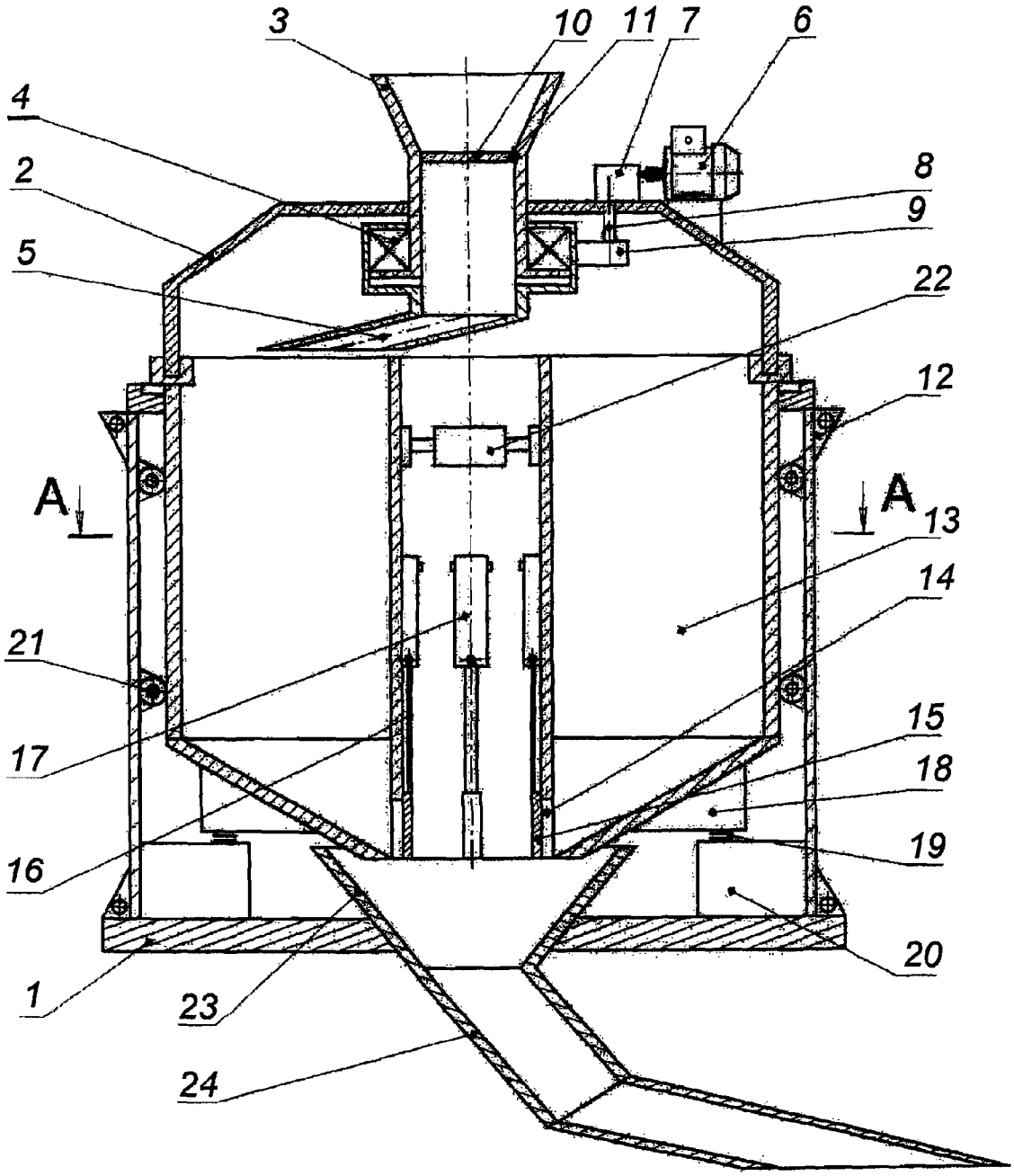
FIG. 1 shows a longitudinal section of an installation for supplying materials into a metallurgical unit.

An installation comprises a housing 1 having a lid 2 placed thereon. A charge funnel 3 is mounted in the lid 2 and has a support bearing 4 mounted in a lower part of the funnel under the lid 2 while a swivel launder 5 is mounted in said bearing. An electrical motor 6 with a gearbox 7 is mounted on the lid 2, an output shaft 8 of said gearbox being coupled to the swivel launder 5 via a driving wheel 9. A partition 10 is mounted in the charge funnel 3 to rotate in a vertical plane around an axis 11 by means of a drive (not shown). The housing 1 is provided with means 12 for fastening to structures of a plant.

Intermediate hoppers 13 are positioned radially in the housing 1, have a cross-section in the form of a segment, and are made removable. Lower parts of the hoppers have discharge openings 14 formed therein and shutters 15 mounted thereon and interconnected by tie rods 16 with pneumatic cylinders 17. Formation of the discharge openings in a surface of the hopper 13 facing a longitudinal axis of the installation makes it possible to provide movement of the shutters 15 along a longitudinal axis of a hopper 13 by means of the pneumatic cylinders 17 placed in a cavity formed by hopper surfaces facing the longitudinal axis of the installation (FIG. 1).

Figure 2:
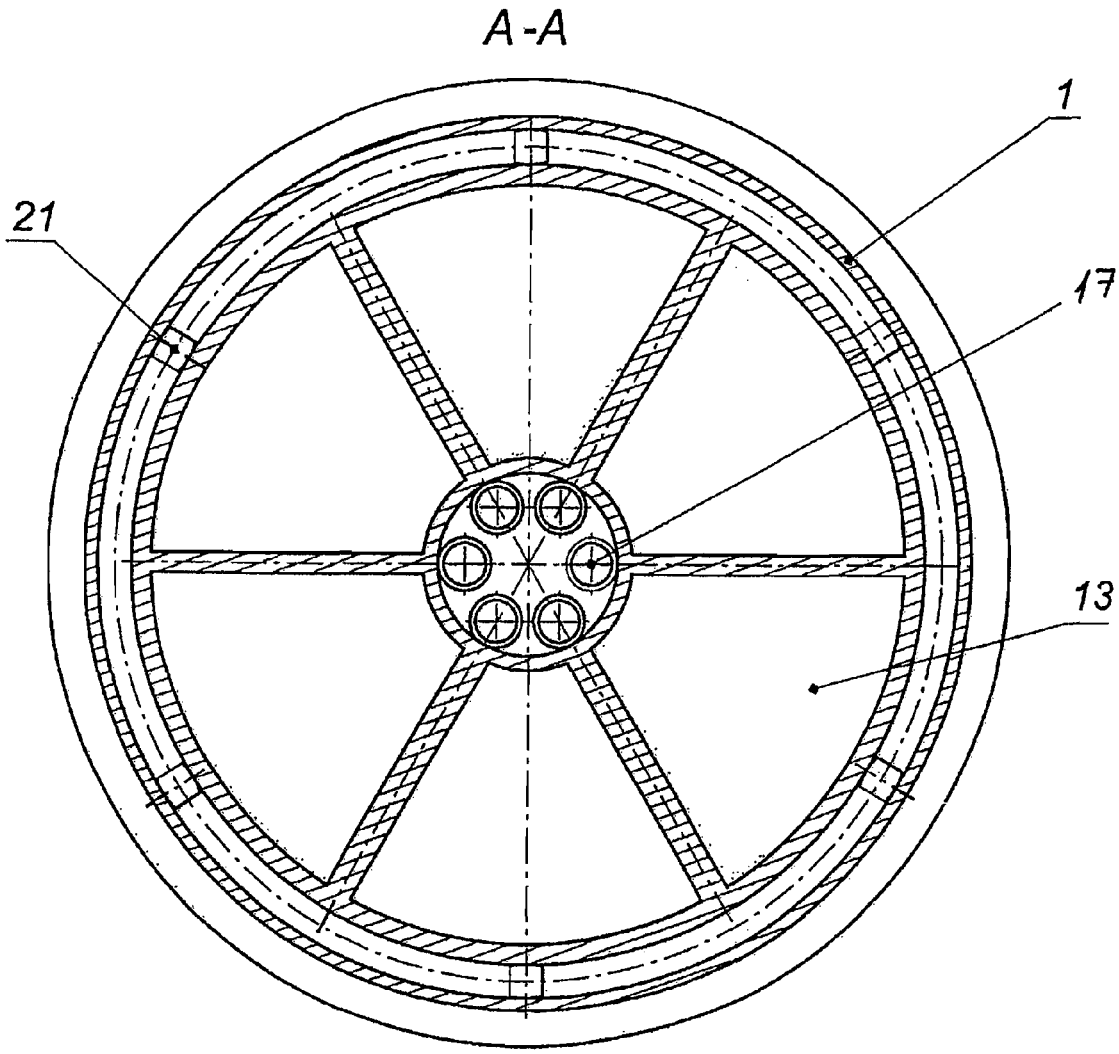
FIG. 2 shows section A-A in FIG. 1.

When the discharge openings are formed in a bottom of a hopper 13, movement of the shutters 15 perpendicularly to the longitudinal axis of the hopper 13 is provided by means of the pneumatic cylinders 17 mounted under the bottom of the hoppers (FIG. 2).

Figure 4:
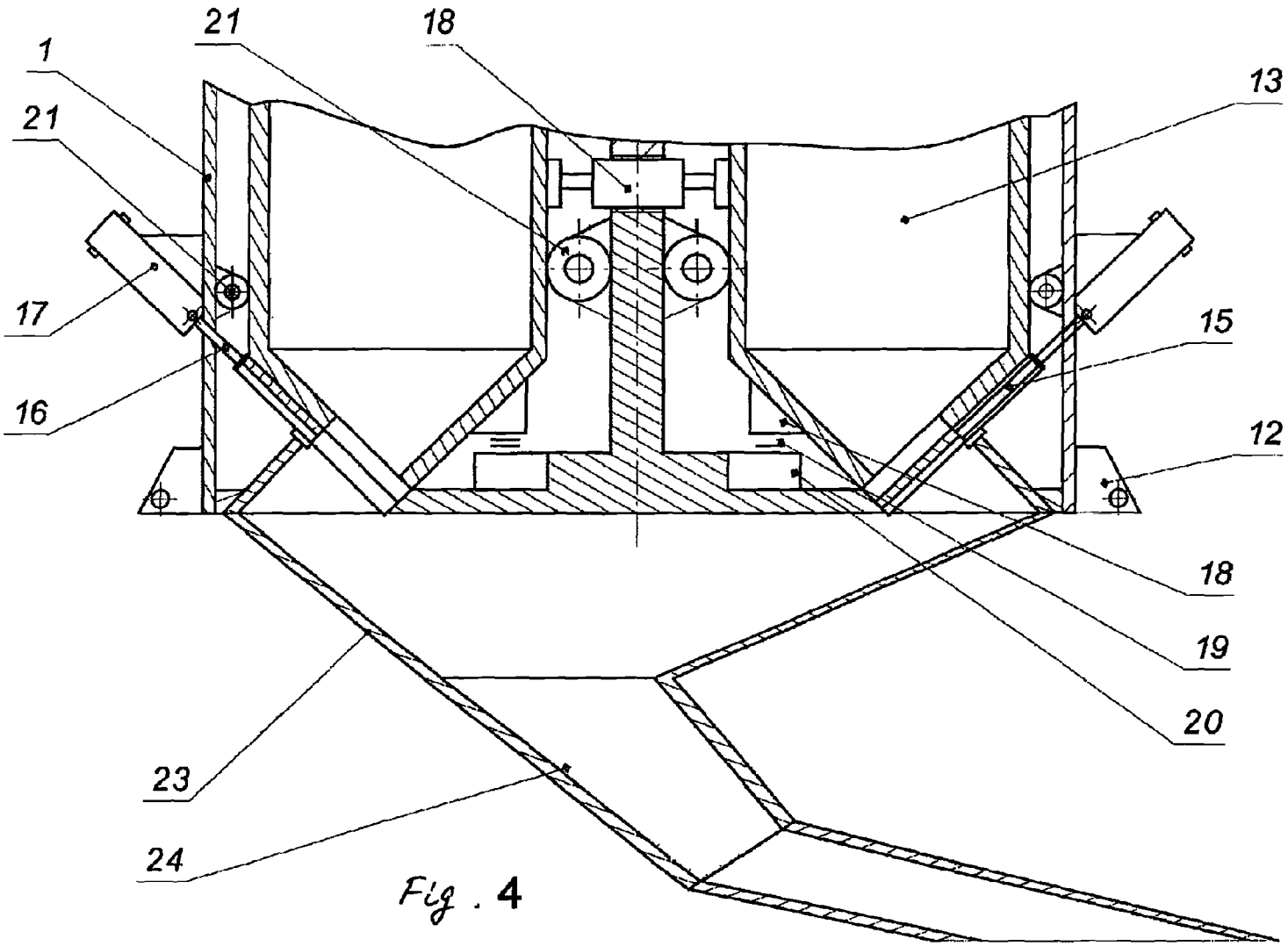
FIG. 4 shows a longitudinal section of the installation with removable hoppers and with shutters mounted to move at an angle to a longitudinal axis of a hopper.

When the bottom of the hopper 13 is formed as a pyramid whose vertex faces the pipe-chute, the discharge openings 14 are formed in a pyramid face facing the housing 1 while movement of the shutters 15 at an angle to the longitudinal axis of the hopper 13 is provided by means of the pneumatic cylinders 17 positioned outside of the housing 1 (FIG. 4).

Figure 3:
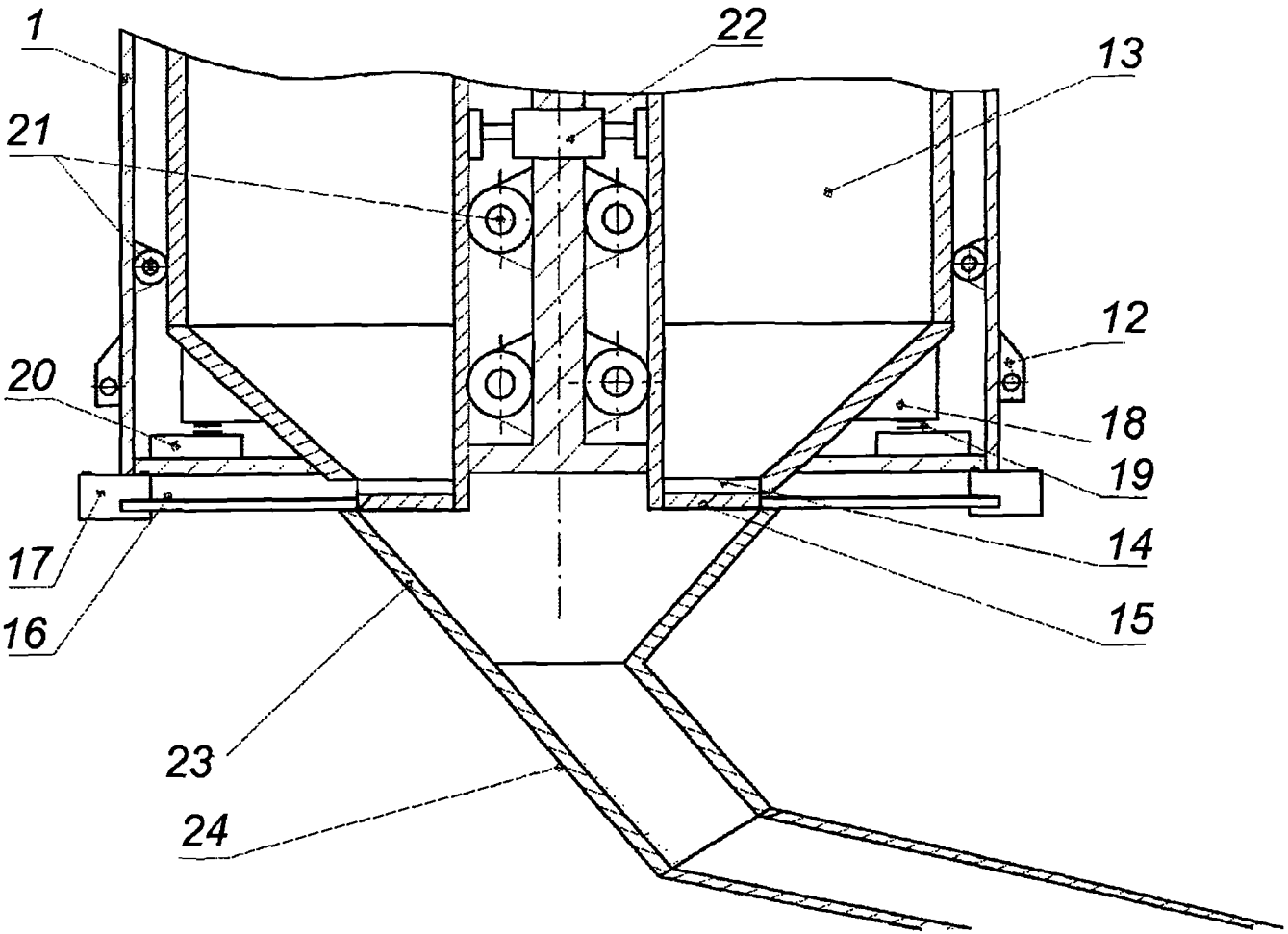
FIG. 3 shows a longitudinal section of the installation with shutters mounted to move perpendicularly to a longitudinal axis of a hopper.

The hoppers 13 have a strain-gauge platform 18 (FIG. 3) mounted on strain-gauge scales 19 whose supports 20 are mounted on components of the housing 1 perpendicular to the longitudinal axis of the installation. The hoppers 13 are interconnected with the housing 1 by means of guide rollers 21 mounted in areas of the housing periphery whose axes are parallel to the longitudinal axis of the installation.

A vibrator 22 interconnected with the hoppers 13 is mounted within a cavity formed by surfaces of the hoppers 13 facing the longitudinal axis of the installation. A pipe-chute 23 with a discharge funnel 24 is mounted in the housing 1.

The installation operates as follows.

The installation for supplying materials into the metallurgical unit for direct steel alloying is preliminary fastened to structures of the plant by the fastening means 12 positioned on the housing 1.

Prior to begin the treatment process in the steelmaking unit or in the steel-teeming ladle or sequentially in both units, the intermediate hoppers are charged with prepared necessary materials by means of a conveyor (not shown in the drawings) in an amount that provides alloying steel of one heat or a series of heats. A material required in accordance with the technology is supplied into the charge funnel 3 mounted in the lid 2, wherein a position of a partition 10, formed to move about the axis 11 in parallel to the longitudinal axis of the installation, provides unimpeded arrival of the materials at the swivel launder 5. Placement of the partition 10 in the charge funnel 3 prevents foreign materials from entering the intermediate hoppers and provides thereby synchronism of melting the raw materials with the reduction process going simultaneously as well as the accuracy of a predictable chemical composition of steel according to elements introduced by means of direct alloying.

The lid 2 placed on the housing 1 fulfils two functions: it guards the materials supplied into the intermediate hoppers from entering the foreign materials thereto and also is a supporting structure for fastening the funnel and the swivel launder therein. When the lid is absent, foreign materials or media, for example, air, moisture, dust, can enter the intermediate hopper resulting thereby in violation of the direct alloying mode during operation of the installation as well as in deterioration of steel for example because of entering hydrogen therein introduced in the supplied materials with moisture. Placement of the charge funnel 3 in the lid provides decrease in the installation weight and increases the operation speed in charge of necessary materials into the intermediate hoppers.

By turning on the electrical motor 6, a torque is transmitted via the gearbox 7, the output shaft 8, and the driving wheel 9 to the swivel launder 5 mounted on the support bearing 4. The swivel launder 5 is mounted above the respective hopper 13 that is filled with the necessary amount of the required material.

Placement of the hoppers in the housing 1 having the lid 2 and provided with the means 12 for fastening to the structures of the plant allows accumulation and supply of the required amount of materials by compact structure of installation, makes it possible to vary the number of the intermediate hoppers along with decrease in the specific amount of metal, while the compact structure makes it possible to transfer the installation operatively within the plant. A structural embodiment of the intermediate hopper 13 with a cross-section in the form of a segment increases the operation speed during supply of necessary materials in operation of the installation because any materials have been supplied in the mode independent from the mode of supplying the materials from other hoppers. This is necessary to provide radial placement of the hopper, to supply simultaneously several materials from several hoppers as well as to prevent hang-up of large-fraction materials (having a size of more than 70 mm) in a hopper. Manufacture of the hoppers removable in the inventive installation provides immediacy in their transportation, assembling of separate assemblies of the installation as well as operation thereof because a chance occurs to replace the intermediate hoppers operatively, without interruption of the steel melting process. The guide rollers 21 mounted in areas of the periphery surface of the housing and having axes parallel to the longitudinal axis of the installation are designed to simplification of placement of the hoppers 13 into the housing 1.

The radial position of the intermediate hoppers in the housing to form a cavity by hopper surfaces facing a longitudinal axis of the installation provides isolation of necessary materials supplied into different hoppers as well as the ability to increase or decrease the capacities of the intermediate hoppers by means of movable partitions depending upon aspects of the technology during operation of the installation. Additionally, the radial position of the intermediate hoppers assists in accelerated supply of necessary materials from said hoppers into the steelmaking unit or into the steel-teeming ladle providing thereby the preset technological regulations of the process for direct steel alloying.

In progress of charge, there is automatic weighting of the materials being charged into the hopper 13 by means of action of the strain-gauge platform 18 to the strain-gauge scales 19 whose supports are 20 are mounted on components of the housing 1 perpendicular to the longitudinal axis of the installation.

Presence of the strain-gauge scales 19 provides improvement in the accuracy of controlling the mass of supplied materials during the direct alloying, and this makes it possible to vary the masses of supplied materials within a wide range, especially in combination of the direct alloying processes with the process of micro-alloying and modifying of steel which also use the manufacturing procedures of direct alloying when the masses of supplied materials are differed by orders.

Similarly, all materials required by the technology are charged into respective hoppers 13.

In progress of treating the metal melt in a respective metallurgical unit, all necessary materials are supplied in a single portion or in controllable portions from the intermediate hoppers 13 in series or simultaneously. A material is discharged through the discharge opening 14 that is uncovered by means of movement of the shutter 15 using the tie rod 16 by the pneumatic cylinder 17. After discharge of the preset amount of material from the hopper 13, the discharge opening 14 is closed. The materials arrive at the discharge funnel 23 and are directed through the pipe-chute 24 into the respective unit. Interconnection of the intermediate units 13 with the pipe-chute 24 through which necessary materials are supplied according to the preset regulations into the steelmaking unit or ladle by means of the discharge openings formed in the hoppers and the mounted shutters 15 provides independent supply of anyone of materials present in the intermediate hopper 13 at any time preset by the technological regulations. This provides solution of the posed problem—creation of favorable conditions for synchronizing the processes of melting the supplied materials with simultaneous reduction of alloying elements—in operation of the installation.

One of bottlenecks in the steelmaking plants of metallurgical industry is provision of a high rate of supplying necessary materials into a steelmaking unit or into ladle. This is accomplished due to structural aspects of the intermediate hoppers in the inventive installation.

Formation of discharge openings 14 in a surface of hoppers facing the longitudinal axis of the installation with placement of the shutters 15 to move along the longitudinal axis of the hopper 13 provides an increased rate of supplying necessary materials into the steelmaking unit or into ladle. This is accomplished by that the discharge openings are positioned in immediate proximity to the funnel 23 and the pipe-chute 24 without an additional supply path and also because of the vertical structure of the hopper that assists in that even large-fraction materials are discharged by gravity without hang-up into the pipe-chute 24 from which they freely arrive at the steelmaking unit or ladle.

When fine-fraction materials (having a size of from 5 to 20 mm) are supplied from the intermediate hopper, and it is necessary to discharge them in compliance with supply of other materials from other hoppers, there is the need to provide necessary supply regulations. For this purpose, it is the most acceptable to form the discharge openings 14 in a bottom of the hoppers 13 with placement of the shutters 15 to move perpendicularly to a longitudinal axis of a hopper with compulsory use of the vibrator 22 in progress of supplying fine-fraction materials.

For especially finely dispersed materials (having a size of less than 2.0 mm) used in the direct alloying process for micro-alloying and modifying of steel, it is reasonable to supply necessary materials in the mode stipulated by technological aspects of direct alloying, exactly, with the possibility to mix the supplied materials in the pipe-chute, with synchronously-series supply of finely dispersed materials of a reducing agent and large-fraction materials such that when the finely dispersed materials entrained by lager particles of other materials fall to a plane of the pipe-chute 24, having achieved a surface of a metal melt, they could immerse into its bulk. This is provided by making a bottom of the hopper 13 in the form of a pyramid whose vertex faces the pipe-chute 24 in case if the cross-section of the hopper is a segment. At the same time, formation of the discharge openings 14 in a pyramid face facing the housing 1, while the shutters 15 are mounted to move at an angle to a longitudinal axis of the hopper 13, assists to provide synchronism of melting the supplied materials and reducing alloying and modifying elements therefrom.

Presence of the vibrator 22 interconnected with the hoppers 13 and included in the installation prevents the material from packing, assists in unimpeded discharge thereof from the hopper 13 and in intensive advance of the supplied materials to the pipe-chute and prevents their hang-up in the hopper thereby to promote solution of the problem posed—to provide the operation speed during supply of raw materials. This results in realization of synchronous processes of melting the raw materials simultaneously with progress of the reduction process.

The installation is designed to realize the technique of direct steel alloying in production of carbonaceous steels, alloyed steels as well as steels that include micro-alloying and modifying additives whose contents in steel are by an order less than that of alloying elements. Therefore, provision of protecting the materials charged into the intermediate hoppers against foreign materials and media is the necessary condition to realize the direct alloying technology. Presence of the partition 10 within the funnel so as to rotate in a vertical plane relative to the longitudinal axis of the installation guards the materials charged into the intermediate hoppers thereby to assist falling within a preset chemical composition of steel to be made and to improve the quality thereof due to decrease of contamination with impurities.

Embodiment 1

The installation was used to supply materials in implementation of the process of direct alloying of a chromium-manganese steel in an oxygen-blown vessel. The direct alloying was performed using nonmetallic materials that contained alloying elements. One material had a fractional composition of from 100 to 150 mm and contained manganese in the oxide form of MnO while another one had a fractional composition of from 10 to 50 mm and contained chromium in the form of $Cr_2O_3$. Each material was preliminary charged into the intermediate hoppers 13 wherein the discharge openings 14 were formed in a surface of the hoppers facing the longitudinal axis of the installation. Uncovering of the openings is provided by the shutters 15 that move along the longitudinal axis of the hopper 13 by means of the pneumatic cylinders 17 placed in a cavity formed by hopper surfaces facing the longitudinal axis of the installation. The intermediate hoppers 13 having the discharge openings 14 formed in the hopper surface facing the longitudinal axis of the installation are used for materials whose fractional composition is larger that 50 mm. Such a structure is the most suitable for large-fraction materials because it provides fast, unimpeded descent of materials from the hopper through the discharge funnel 23 into the pipe-chute 24.

A carbonaceous material of the fraction from 10 to 15 mm, preliminary charged into the intermediate hopper 13 having the discharge opening 14 formed in the bottom of the intermediate hopper 13, said opening being uncovered by movement of the shutter 15 perpendicularly to the longitudinal axis of the hopper 13 by means of the pneumatic cylinder 17 mounted under the bottom of the hopper 13, was used as a reducing agent for alloying elements. The hoppers 13 having the discharge openings 14 positioned in the bottom of the hoppers 13, said openings being uncovered by movement of the shutter 15 perpendicularly to the longitudinal axis of the hoppers 3 by means of the pneumatic cylinders 17 mounted under the bottoms of the hoppers 13, are used for fine-fraction materials (10 to 15 mm). Such formation of the discharge openings provides descent of fine-fraction materials at a controllable rate thereby to allow implementation of the process of direct steel alloying in accordance with technological requirements when the charged materials enter the steelmaking unit, in other words, synchronism of the processes of melting the supplied materials and reducing the alloying elements therefrom is accomplished.

The installation operates as follows.

Materials taken from each hopper 13 and in the ratio of Mn/Cr=2:1 in portions each being 20% of their total output are supplied simultaneously from the intermediate hoppers 13 containing alloying element oxides through the discharge funnel 23 into the pipe-chute 23 from which they are charged into the oxygen-blown vessel. Each portion of materials is weighted by the strain-gauge scales 19 whose supports are 20 are mounted on components of the housing 1. This makes it possible to supply the material in checked portions which further provides uniform distribution thereof over a surface of the metal melt in the oxygen-blown vessel and assists in combining of the processes of melting the supplied materials and reducing the alloying elements.

The reducing agent is also supplied by portions, each being 20% of their total output through the discharge opening 14 positioned in the intermediate hopper 13, through the discharge funnel 23 into the pipe-chute 24 from which it arrives at the oxygen-blown vessel, wherein the vibrator 22 mounted in a cavity formed by surfaces of the hopper 13 facing the longitudinal axis of the installation is turned on in supply of said agent. This provides intensive descent of the reducing fine-fraction material from the intermediate hopper through the pipe-chute into the oxygen-blown vessel. Each portion of the reducing agent is weighted by the strain-gauge scales 19 whose supports are 20 are mounted on components of the housing 1. This makes it possible to supply the reducing agent in checked portions which further provides uniform distribution thereof over a surface of a metal melt in the oxygen-blown vessel and assists in combining of the processes of melting the supplied materials and reducing the alloying elements.

Embodiment 2

The installation was used to supply materials in implementation of the processes of manganese alloying and vanadium micro-alloying of a structural steel in a ladle furnace installation using the technique of direct steel alloying. The alloying was performed using nonmetallic materials that contained alloying elements in their composition: one material had a fractional composition of from 20 to 50 mm and contained manganese in the oxide form of MnO while another one had a fractional composition of from 1.0 to 1.5 mm and contained vanadium in the form of $V_2O_5$. Granulated aluminum having the fraction from 8 to 10 mm was used as a reducing agent.

Each material was preliminary charged into the intermediate hoppers 13. The manganese-containing material was charged into the hopper 13 wherein the discharge opening 14 was formed in its surface facing the longitudinal axis of the installation and was uncovered by the shutter 15 moved along the longitudinal axis of the hopper 13 by means of the pneumatic cylinder 17 placed in a cavity formed by hopper surfaces facing the longitudinal axis of the installation. Granulated aluminum was charged into the intermediate hopper 13 having the discharge opening 14 formed in its bottom and being uncovered by movement of the shutter 15 perpendicularly to the longitudinal axis of the hopper 13 by means of the pneumatic cylinder 17 mounted under the bottom of the hopper 13. The vanadium-containing material was charged into the hopper 13 having the bottom in the form of a pyramid whose vertex faces the pipe-chute while the discharge opening 14 is formed in a pyramid face facing the housing 1 and is uncovered by movement of the shutter 15 at an angle to the longitudinal axis of the hopper 13, said movement being provided by means of the pneumatic cylinder 17 mounted outside of the housing 1. The hoppers 13 having the bottom in the form of a pyramid whose vertex faces the pipe-chute while the discharge opening 14 is formed in a pyramid face facing the housing 1 and is uncovered by movement of the shutter 15 at an angle to the longitudinal axis of the hopper 13, said movement being provided by means of the pneumatic cylinder 17 mounted outside of the housing 1, are used for fine-fraction materials (1.0 to 1.5 mm). Such formation of the discharge opening provides controllable descent of finely dispersed materials in the continuous, discrete or mixed supply modes. This provides the possibility to realize technological modes for modifying of steel using the direct alloying procedures when a finely dispersed nonmetallic material containing an alloying element oxide or carbide in its composition should be blended with a reducing agent prior to all materials fall onto a surface of the metal melt.

The installation operates as follows.

The manganese-containing material is supplied from the intermediate hopper 13 through the discharge funnel 23 into the pipe-chute 23 from which it is charged into the ladle furnace to the surface of the molten metal. Granulated aluminum is also charged that way from the hopper 13 comprising the reducing agent and goes through the discharge funnel 23 into the pipe-chute 24. The vibrator 22 mounted in a cavity formed by surfaces of the hoppers 13 facing the longitudinal axis of the installation is turned on during supply of aluminum. This provides intensive descent of the reducing fine-fraction material from the intermediate hopper through the pipe-chute into the ladle furnace. Such a supply of materials provides uniform distribution thereof over a surface of a metal melt in the ladle furnace and assists in combination of the processes of melting the supplied materials and reducing the alloying element.

Each portion of materials is weighted by the strain-gauge scales 19 whose supports are 20 are mounted on components of the housing 1.

The vanadium micro-alloying of steel is performed by supplying the vanadium-containing material and the reducing agent—granulated aluminum—on the ladle furnace. The vanadium-containing material from the intermediate hopper 13 goes through the discharge funnel 23 and arrives at the pipe-chute 24 from which it is charged in the ladle furnace to the surface of the molten metal. Granulated aluminum is supplied that way too. The vibrator 22 mounted in a cavity formed by surfaces of the hoppers 13 facing the longitudinal axis of the installation is turned on in progress of supplying said materials. This provides intensive descent of the fine-fraction vanadium-containing material and the fine-fraction composition of granulated aluminum from the intermediate hopper through the pipe-chute into the ladle furnace.

Each portion of materials is weighted by the strain-gauge scales 19 whose supports are 20 are mounted on components of the housing 1.

Such a supply of materials provides uniform distribution thereof over the surface of the metal melt in the ladle furnace and assists in combining of the processes of melting the supplied materials and reducing the alloying element.

INDUSTRIAL APPLICABILITY

Thus, as seen from the embodiments above, use of the instant invention provides the operation speed in supply of materials into a metallurgical unit. Such an installation provides compliance with the required regulations for supplying materials in the process of direct steel alloying allowing thereby the synchronization of the processes of melting the supplied materials and reducing the alloying elements.

Structural aspects of the installation provide not only the possibility to charge materials in a preset sequence but also the possibility to supply materials in a single portion or discretely in equal or controllable portions at a controllable rate of supplying materials.

Use of the inventive installation for supplying materials into a metallurgical unit significantly decreases a path length, that is, a length of the material motion from the plant hoppers to the metal melt and increases the rapidity of supplying materials by preliminary gathering all materials for melting.

What is claimed is:

1. An installation for supplying materials into a metallurgical unit, comprising a distributing device made as a funnel and a swivel launder with a drive, and intermediate hoppers coupled to a pipe-chute, wherein the installation is provided with a housing having a lid and means for fastening to structures of a plant, wherein the funnel is mounted in the lid, the swivel launder is mounted under the lid, and the intermediate hoppers are positioned radially in the housing to form a cavity by hopper surfaces facing a longitudinal axis of the installation, said cavity being separated from the interior of the hoppers, wherein the hoppers are coupled to the pipe-chute by means of discharge openings formed therein and shutters mounted to move relative to a longitudinal axis of a hopper.

2. An installation according to claim 1, wherein a hopper cross-section is a segment.

3. An installation according to claim 1, wherein the intermediate hoppers are made removable.

4. An installation according to claim 1, wherein the housing is provided with partitions mounted radially therein to move along the longitudinal axis of the installation.

5. An installation according to claim 1, wherein the housing is made frame-shaped.

6. An installation according to claim 1, wherein the discharge openings are made in a surface of hoppers facing the longitudinal axis of the installation while the shutters are mounted to move along a longitudinal axis of a hopper by means of pneumatic cylinders placed in a cavity formed by hopper surfaces facing the longitudinal axis of the installation.

7. An installation according to claim 1, wherein the discharge openings are formed in a bottom of hoppers while the shutters are mounted to move perpendicularly to a longitudinal axis of a hopper by means of pneumatic cylinders placed under the bottom of hoppers.

8. An installation according to claim 1, wherein a hopper bottom is formed as a pyramid whose vertex faces the pipe-chute.

9. An installation according to claim 1, wherein the discharge openings are formed in a pyramid face facing the housing while the shutters are mounted to move at an angle to a longitudinal axis of a hopper by means of pneumatic cylinders positioned outside of the housing.

10. An installation according to claim 1, wherein the hoppers are mounted on strain-gauge scales and coupled to the housing by means of guide rollers mounted in areas of the housing periphery surface whose axes are parallel to the longitudinal axis of the installation.

11. An installation according to claim 1, wherein the installation is provided with a vibrator interconnected with the hoppers.

12. An installation according to claim 1, wherein a partition is mounted within the funnel to rotate in a vertical plane relative to the longitudinal axis of the installation.

* * * * *